United States Patent [19]

German

[11] Patent Number: 5,022,238

[45] Date of Patent: Jun. 11, 1991

[54] SETTING FOR FINE AND COSTUME JEWELRY

[76] Inventor: Hassan J. German, En Llop, 1 46002, Valencia, Spain

[21] Appl. No.: 569,230

[22] Filed: Aug. 17, 1990

Related U.S. Application Data

[63] Continuation of Ser. No. 232,439, Aug. 15, 1988, abandoned.

[30] Foreign Application Priority Data

Oct. 22, 1987 [ES] Spain ..... 8703263[U]

[51] Int. Cl.[5] ..... A44C 17/02

[52] U.S. Cl. ..... 63/26; 63/4; 63/29.1

[58] Field of Search ..... 63/26, 28, 29.1, 30, 63/32; 29/10, 160.6

[56] References Cited

U.S. PATENT DOCUMENTS 811,693 2/1906 Calvo ..... 63/4
997,225 7/1911 Allen ..... 63/4
1,569,563 1/1926 Muller ..... 63/29.1 X
4,742,696 5/1988 Jenkins ..... 63/29.1 X

FOREIGN PATENT DOCUMENTS 318913 3/1902 France ..... 63/26

*Primary Examiner*—Laurie K. Cranmer
*Attorney, Agent, or Firm*—Baker & Botts

[57] ABSTRACT

Apparatus is provided for setting fine and costume jewelry. Frame (1) and frame (2), each being of substantially similar dimensions, are formed symmetrically around foldable connecting bridge 93). Tab (7) is formed on frame (1) along an axis passing through connecting bridge (3). Tab (8) is formed on frame (2) along an axis passing through connecting bridge (3) and tab (7). Tab (8) is substantially longer than tab (7). Frame (1) is folded around foldable connecting bridge (3) and onto frame (2) such that frame (1) and frame (2) mate along their lengths, and such that tab (7) lies adjacent to tab (8). The distal portion of tab (8) is then folded over tab (7) to complete the fastening together of frame (1) and frame (2).

4 Claims, 1 Drawing Sheet

SETTING FOR FINE AND COSTUME JEWELRY

RELATED APPLICATIONS

This application is a continuation of application Ser. No. 07/232,439, filed Aug. 15, 1988, now abandoned, entitled SETTING FOR FINE AND COSTUME JEWELRY by Hassan Jacoub German.

This Utility Model refers to a setting for jewelry and costume jewelry, and more specifically a setting for mounting parts and the like intended to form pendants, necklaces, chains, etc.

Mounting stones in jewelry and costume jewelry always offers problems, derived mainly from the firmness of the support or setting in which the stone is mounted and the guarantee that this setting offers against the stone coming away.

The problem mentioned increases when the stones are intended to form links of chains or small necklaces, as on these occasions the support or setting is not very strong.

To obtain a secure setting for stones, complicated setting designs have to be used in these cases, also calling for delicate and complicated mounting operations which have to be performed by very expert hands, consequently making the product more expensive.

The object of this invention is to develop a setting for jewelry and costume jewelry which enables the stones to be mounted quickly and securely, reducing to a minimum the risk of the mounted stones coming away.

With the setting in the invention, whatever the configuration and cut of the stones, they can be mounted through a reduced number of simple operations, which require no highly skilled labour, reducing costs through less time being necessary for mounting, and the lower cost of labour employed.

Furthermore, the setting in the invention is made in such a way that it provides perfect protection and secures the stone mounted, thereby ensuring the duration of the jewelry article or costume jewelry.

Yet another advantage of the link in the invention is that it can be used alone as a link for forming chains to be used as necklaces, bracelets, etc.

According to the invention, the setting is made up of two equal frames backing onto each other, which are joined symmetrically by a flat narrow connecting bridge, the two frames and the bridge forming a single part. The said connecting bridge is provided with two drills, each of which is adjacent to one of the frames, being slightly separated.

Furthermore, the two frames making up the setting stretch from diametrically opposite points to that occupied by the connecting bridge, into two flat narrow end tongues, aligned to the said bridge. These two tongues differ in length, the shorter one having one hold and the longer tongue having two holes.

Both the connecting bridge of the setting and the longer tongue can be folded transversally along its central part at 180°.

On bending the connecting bridge 180°, the two holes in the said bridge face each other and the two frames back onto each other, fitting together. The end tongue also back onto each other, the long tongue being able to fold itself 180° transversally along its central part, so that the folded end portion backs onto the small tongue, with the three holes in line.

In this way, the frames back onto each other and the whole unit is closed by the fold of the end tongue. On both sides of this assembly, holes are formed for the links to be hooked, enabling the formation of chains.

The frames have a growing internal section towards their opposite surfaces, so that by fitting the two frames together, they form a housing in which to mount the stone, which will be visible and can also partially protrude through the hole in the said frames.

The setting disclosed is obtained from a flat part or metal plate, by cutting, die-pressing and partially inlaying the frames.

To assist bending the connecting bridge and the longer end tongue, these portions have a central narrow part which forms or defines the folding line.

Preferably, around the drills, the connecting bridge and the end tongues will have curved edges, concentric with the said drills, to be shaped like rings.

The two frames making up the link of the invention could be completely closed, in which case by being folded by the connecting bridge and folding the end tongue, metal links would be obtained for forming chains.

The features and advantages set forth will be understood better with the following description, made with reference to the attached drawings, in which a possible form of embodiment is illustrated, given by way of unlimiting example.

Figure 1:
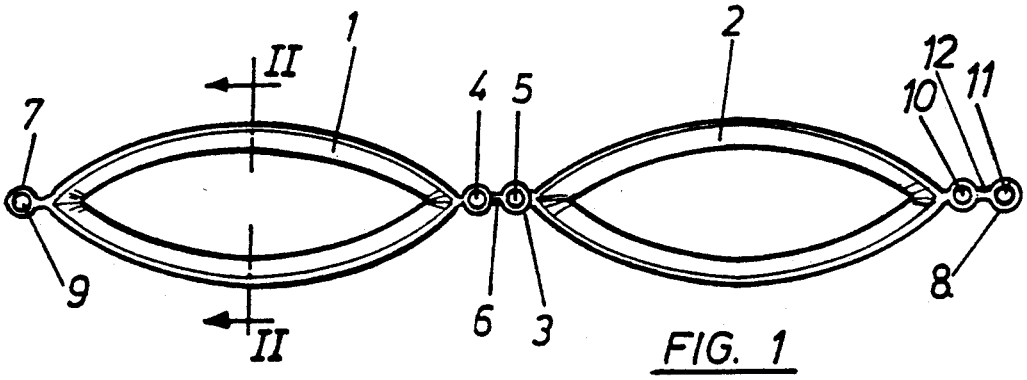
FIG. 1 is a plan view of an unfolded setting, made in accordance with the invention.
Figure 2:
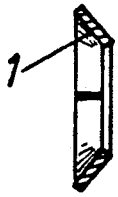
FIG. 2 is a cross-section, on a larger scale, according to the cutting line A—A of FIG. 1.

As can be seen in FIGS. 1 and 2, the setting in the invention is made up of two equal frames, marked with reference numbers 1 and 2, which form contours adapted to the type of stone to be mounted in them.

In the example disclosed, these frames adopt an approximately oval shape, but they could have a circular, triangular, square or pentagonal contour, etc.

Frames 1 and 2 are joined together by an intermediate bridge 3, these frames occupying symmetric positions. The bridge 3 is provided with two drills, 4 and 5, each of which is adjacent to one of the frames. Also, the bridge 3 has an intermediate narrowing 6. The frames 1 and 2 extend by diametrically opposing points to that occupied by the bridge 3, into different lengthed tongues 7 and 8. Tongue 7 has one drill 9, while tongue 8 has two drills 10 and 11, separated by an intermediate narrowing 12.

Around the respective drills, both the connecting bridge 3 and the end tongues 7 and 8 have curved edges concentric to the said drills, adopting the form of rings.

The assembly illustrated in FIG. 1 is obtained from a plate, by cutting, die-pressing and partially inlaying the frames 1 and 2, so that these frames, as shown in FIG. 2, have a growing cross-section towards their opposite surfaces.

The setting for mounting stones is shaped by backing the frames 1 and 2, for which the connecting bridge 3 is folded transversally by the intermediate narrowing 6. The frames 1 and 2 are backed in a coinciding position. The drills 4 and 5 will face each other and in the same way, the drill 9 of the tongue 6 will face the drill 10 of the tongue 8. The tongue 8 is then folded transversally 180° through the intermediate narrowing 12, so that the end portion with the hole 11 is placed on the tongue 7, holes 9, 10 and 11 facing each other, and with the setting closed, as shown in FIGS. 3 to 5.

Figure 5:
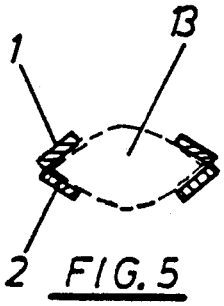
FIG. 5 is a section according to the cutting line B—B of FIG. 4.

As can be seen in FIG. 5, the two fitted frames form a housing in which the stone 13 is mounted, which will be visible and may protrude partially through the openings of the said frames.

Figure 3:
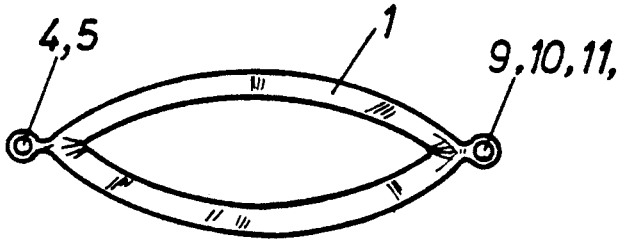
FIG. 3 shows the setting of FIG. 1, or folded, and with a stone mounted in it.
Figure 4:
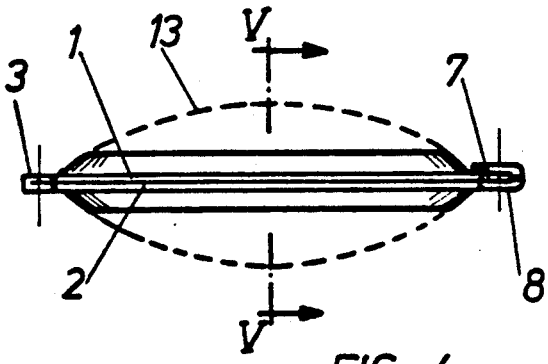
FIG. 4 is a side view of the setting in FIG. 3.

In FIG. 4 it can be seen how frames 1 and 2 back onto each other, with the connecting bridge 3 folded 180°, surrounding the shorter tongue 7. As seen in FIG. 3, in this folded end mounted position of the setting, the two holes 4 and 5 of the intermediate bridge face each other, as also do the holes 9, 10 and 11 of the end tongues, forming rings to hold the connecting links.

With the layout disclosed, to mount stones, it suffices to place the latter on one of the frames of the unfolded setting in FIG. 1, then folding the intermediate bridge 3 and the end tongue 8, to obtain the mounting shown in FIGS. 3 to 5.

The frames 1 and 2 could be completely closed, defining convex or polyhedric surfaces which, once assembled, form metal links for making chains.

After sufficiently disclosing the nature of the invention and the way of executing it in practice, it should be stated that the above arrangement is liable to modification in detail, provided this does not alter its basic principle.

What is claimed is:

1. A setting for the mounting of stones and the like in fine and costume jewelry, comprising:

first and second frame means, each said frame means formed by first and second elongated peripheral sidewalls surrounding an opening, and each having first and second ends, a length between said first and second ends of said first frame means approximating a length between said first and second ends of said second frame means;

each frame means having a face and a back opposite said face, each respective sidewall of each said frame means extending from a respective face and sloping laterally outwardly to a respective back;

a bridge formed between said first ends of said first and second frame means, said first frame means adapted to be folded about an axis passing through said bridge such that said back of said first frame means is opposed to said back of said second frame means, said first and second frame means mating along their lengths for securing conmensurately a shaped stone therebetween such that the stone can be seen through the openings; and first and second tab means mounted on said second ends of said frame means, respective first and second for locking said first and second frame means together secured within said frames.

2. The setting of claim 1, wherein said tab means further include holes for receiving connecting links to suspend the setting from another part of a jewelry piece, said holes being of a diameter smaller than the width of said sidewalls.

3. The setting of claim 2, wherein said second tab means includes two of said holes, one of which is formed in a distal portion thereof, said first tab means having a single hole, said holes aligned with each other when the fastening of said first frame means to said second frame means is completed.

4. The setting of claim 1, wherein said frame means are of a curved shape.

* * * * *